United States Patent [19]

Yoshiyasu et al.

[11] Patent Number: 4,642,428

[45] Date of Patent: Feb. 10, 1987

[54] CIRCUIT INTERRUPTER

[75] Inventors: Hajimu Yoshiyasu; Mitsugu Takahashi, both of Itami; Fumiyuki Hisatsune; Shiro Murata, both of Fukuyama, all of Japan

[73] Assignee: Mitsubishi Denki Kabushiki Kaisha, Tokyo, Japan

[21] Appl. No.: 732,071

[22] Filed: May 9, 1985

[30] Foreign Application Priority Data

| | | | |
|---|---|---|---|
| Aug. 15, 1984 | [JP] | Japan | 59-169391 |
| Aug. 15, 1984 | [JP] | Japan | 59-169392 |
| Aug. 15, 1984 | [JP] | Japan | 59-169395 |
| Aug. 15, 1984 | [JP] | Japan | 59-169398 |
| Aug. 15, 1984 | [JP] | Japan | 59-169399 |
| Aug. 15, 1984 | [JP] | Japan | 59-169403 |
| Aug. 15, 1984 | [JP] | Japan | 59-169404 |
| Aug. 15, 1984 | [JP] | Japan | 59-169405 |

[51] Int. Cl.[4] ..... H01H 33/20

[52] U.S. Cl. ..... 200/144 R; 200/147 R

[58] Field of Search ..... 200/144 R, 147 R

[56] References Cited

U.S. PATENT DOCUMENTS

| | | | |
|---|---|---|---|
| 2,821,594 | 1/1958 | Latour | 200/147 R |
| 4,237,355 | 12/1980 | Fechant et al. | 200/147 R |
| 4,560,847 | 12/1985 | Mori | 200/144 R |

FOREIGN PATENT DOCUMENTS

| | | | |
|---|---|---|---|
| 233101 | 4/1964 | Austria | 200/147 R |
| 378388 | 7/1964 | Switzerland | 200/147 R |

*Primary Examiner*—Robert S. Macon

*Attorney, Agent, or Firm*—Leydig, Voit & Mayer

[57] ABSTRACT

A circuit interrupter comprising a stationary conductor carrying a stationary contact, a movable contact arm carrying thereon a movable contact which, when in the open position, defines an arcing region together with the stationary contact, an operating mechanism for moving the movable contact arm between contact closed and open positions, an arc extinguisher facing toward the arcing region for cooling and extinguishing the electric arc, an arc horn for transferring thereon one leg of the electric arc, and an arc runner mounted on the stationary conductor for transferring thereon the other leg of the electric arc from the stationary contact. The arc runner has formed therein an arc runner slot which opens to substantially surround the arcing region, and the arc runner and the stationary contact are positioned such that at least one of the movable contact and the arc horn of the movable contact arm is located within the arc runner slot of the arc runner when the contacts are in the closed position.

21 Claims, 46 Drawing Figures

CIRCUIT INTERRUPTER

BACKGROUND OF THE INVENTION

This invention relates to a low-voltage circuit interrupter.

PRIOR ART

FIGS. 1 to 4 schematically illustrate one example of a conventional low-voltage circuit interrupter. As shown in FIGS. 1 and 2, the circuit interrupter comprises in a housing 2 a stationary conductor 4 carrying the stationary contact 6 thereon and a movable contact arm 8 carrying a movable contact 10 thereon. The circuit interrupter also comprises an operating mechanism 12 for moving the movable contact arm 8 between contact-closed and contact-open positions in response to an overcurrent flowing through the circuit interrupter. As is well known in the art, the stationary and movable contacts 6 and 10, respectively, defines therebetween an arcing region 14 is which an electric arc A (FIG. 2) is established when the contacts 6 and 10 are tripped open by the operating mechanism 12. The circuit interrupter also comprises an arc extinguisher 16 including a plurality of arc extinguisher plates 18 having U-shaped cut-out portions disposed in a facing relationship with the arcing region 14 for cooling and extinguishing the electric arc A, and an arc runner 20 mounted on the stationary conductor 4 for transferrng thereon one of the legs of the electric arc A from the stationary contact 6.

When the circuit interrupter is in the contact-closed position in which the movable contact 10 is in engagement with the stationary contact as shown is FIG. 3, an electric current flows from an electric source (not shown) through the stationary conductor 4, the stationary contact 6, the movable contact 10, the movable contact arm 8 and through the operating mechanism 12 to a load (not shown). When an overcurrent such as a short circuiting current flows through the circuit interrupter, the operating mechanism 12 automatically actuates to rotate the movable contact arm 8 about the shaft 13 in the counterclock-wise direction as viewed in FIG. 3 to put the contacts in the contact-open position shown in FIG. 4. At this time, the electric arc A is generated between the movable and stationary contacts 6 and 10 and an arc voltage appears across the stationary contact 6 and the movable contact 10. This arc voltage increases as the the separation distance between the movable and the stationary contacts 10 and 6 increases. Also, since the arc A is magnetically driven toward the arc extinguisher 16 to be elongated to further increase the arc voltage. When a zero crossing point is reached, the electric arc A is extinguished whereby the current is interrupted.

During the contact-opening operation, the movable contact arm 8 rotates about the shaft 13, and as the rotation of the movable contact arm 8 progresses, the distance between the movable contact 10 and the stationary contact 6 rapidly increases while the distance between the movable contact arm 8 and the stationary conductor 4 increases relatively slowly. Therefore, at certain separation angle of the contact arm 8, the distance between a midportion 8*a* of the movable contact arm 8 and the tip portion 4*a* of the stationary conductor 4 becomes shorter than the distance between the movable contact 10 and the stationary contact 6, whereupon the arc A transfers to the position across the shorter distance to extend between the midportion 8*a* and the stationary conductor tip 4*a* as illustrated in FIG. 4. While the arc A in this position is subjected to an electromagnetic force F toward the arc extinguisher 16 (FIG. 1 and 2) which is a resultant force of electromagnetic forces due to a current $I_1$ flowing through the stationary conductor 4 and a current $I_2$ flowing through the movable contact arm 8, this electromagnetic force F is relatively small and not sufficient to move the arc A from the position shown in FIG. 4 because the contact assembly structure is substantially straight when in the closed position shown in FIG. 3. Therefore, the arc A stays at the illustrated position at which the distance between the conducting members is the shortest, and fails to contact with the arc extinguisher 16, whereby the arc A cannot be effectively quenched by the arc extinguishing plates 18 of the arc extinguisher 16, obstracting the design of a desired circuit interrupter of a desired interrupting capability.

With a circuit interrupter of which contact assembly is configured so that the distance between the contacts 6 and 10 is always shortest irrespective of the position of the movable contact arm 8, the legs of the arc A stay on the movable and the stationary contacts 10 and 6. In this case, while the arc A may be cooled by the arc extinguisher 16, the errosion or consumption of the contact material of the movable and the stationary contacts 6 and 10 due to a hot arc A is promoted, resulting in a serious obstruct for increasing the interrupting capacity of the circuit interrupter.

SUMMARY OF THE INVENTION

Accordingly, an object of the present invention is to provide a circuit interrupter exhibiting a higher current interrupting capability.

Another object of the invention is to provide a circuit interrupter in which the position of the legs of the electric arc at the instant of the current zero crossing point is controlled in a proper position.

Another object of the present invention is to provide a circuit interrupter in which the arc can be effectively quenched.

Still another object of the invention is to provide a circuit interrupter in which the wear of the contact is minimized.

With the above objects in view, the circuit interrupter of the present invention comprises a stationary conductor carrying a stationary contact, a movable contact arm carrying thereon a movable contact which, when in the open position, defines an arcing region together with the stationary contact, an operating mechanism for moving the movable contact arm between contact-closed and contact-open positions, an arc extinguisher facing toward the arcing region for cooling and extinguishing the electric arc, an arc horn for transferring thereon one leg of the electric arc, and an arc runner mounted on the stationary conductor for transferring thereon the other leg of the electric arc from the stationary contact. The arc runner has formed therein an arc runner slot which opens to substantially surround the arcing region, and the arc runner and the stationary contact are positioned such that at least one of the movable contact and the arc horn of the movable contact arm is located within the arc runner slot of the arc runner when the contacts are in the closed position.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
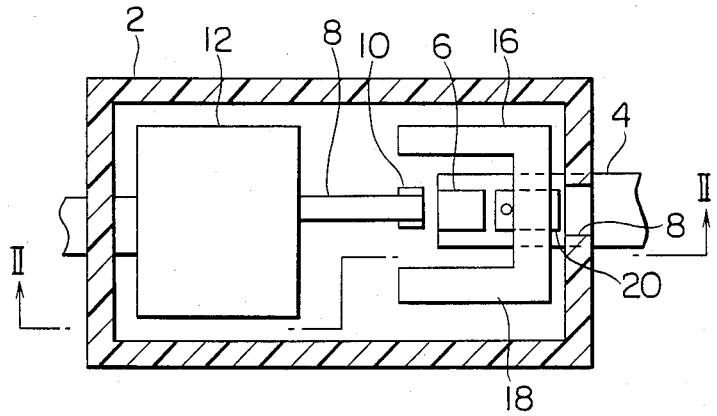
FIG. 1 PRIOR ART
FIG. 1 is a schematic sectional plan view of a conventional circuit interrupter.
Figure 2:
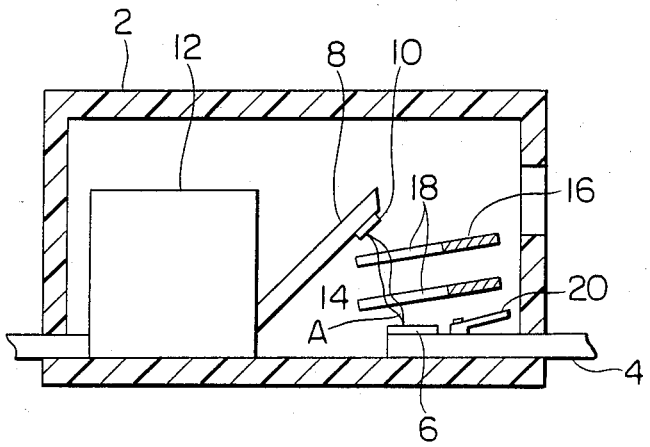
FIG. 2 PRIOR ART
FIG. 2 is a schematic sectional side view of the circuit interrupter of FIG. 1.
Figure 3:
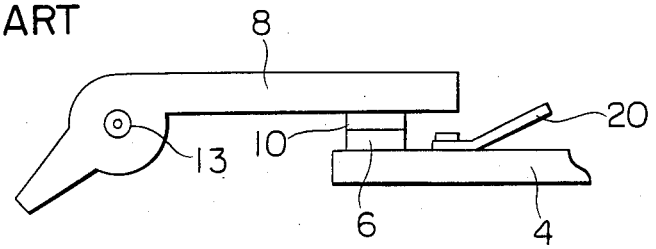
FIG. 3 PRIOR ART
FIG. 3 is a side view of the movable and the stationary contact assemblies of the conventional design in the contact closed position.
Figure 4:
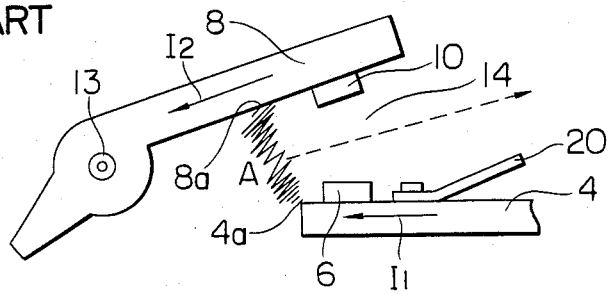
FIG. 4 PRIOR ART
FIG. 4 is a side view of the movable and the stationary contact assemblies of FIG. 3 in the contact open position.
Figure 5:
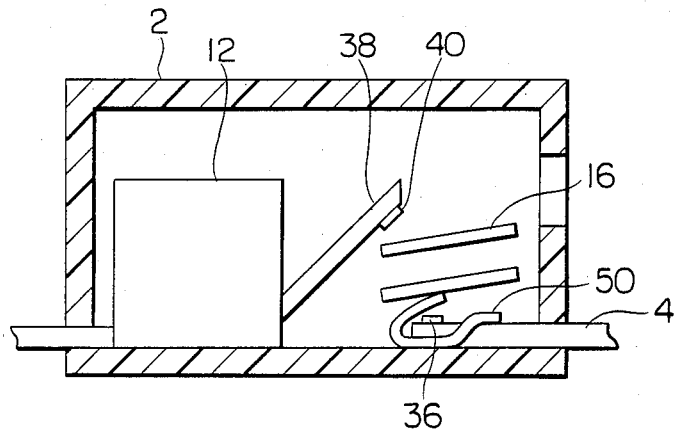
FIG. 5 is a schematic sectional side view of the circuit interrupter of the present invention.

In FIGS. 5 to 9 in which one embodiment of the present invention is illustrated, the circuit interrupter comprises, in a housing 2 having an arc exhaust port 3, a stationary conductor 24 carrying a stationary contact 36 thereon and a movable contact arm 38 carrying a movable contact 40 thereon. The circuit interrupter also comprises an operating mechanism 12 for moving the movable contact arm 38 between contact closed position shown in FIG. 7 and contact open position shown in FIG. 9 in response to an overcurrent flowing through the circuit interrupter. The stationary and movable contacts 36 and 40 define therebetween an arcing region 44 in which an electric arc A is established when the contacts 36 and 40 are tripped open by the operating mechanism 12. The circuit interrupter also comprises an arc extinguisher 16 including a plurality of arc extinguisher plates 18 with its U-shaped cut-out portion disposed in a facing relationship with the arcing region 44 for cooling and extinguishing the electric arc A as is well known in the art.

As best shown in FIGS. 6 to 9, the stationary conductor 24 has a U-shaped bent portion 26 including two legs 28 and 30 and a bight portion 32. The tip 34 of the leg 30 is bent outwardly toward the general direction of the extension of the conductor 24 to provide a substantially flat portion on which the stationary contact 36 is mounted. The movable contact arm 38 carrying a movable contact 40 has integrally formed at its tip an arc horn 42. The movable contact arm 38 is operatively supported by a conventional operating mechanism 12 shown in FIG. 5 for moving the movable contact 40 between the contact-closed position (FIG. 7) and the contact open position (FIG. 9) through a contact-opening intermediate position shown in FIG. 8. When the movable and stationary contacts 36 and 40 are separated, the arcing region 44 is defined between them within which the electric arc A is generated.

Figure 8:
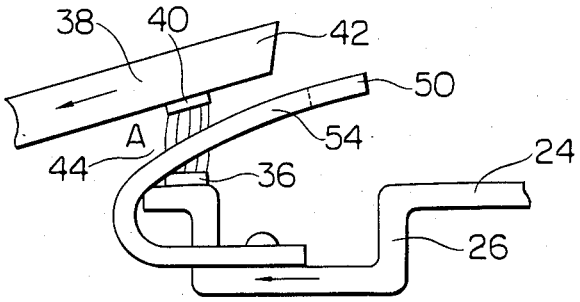
FIG. 8 is side view of the movable and the stationary contact assemblies with the arc runner of the present invention in the contact opening state.
Figure 9:
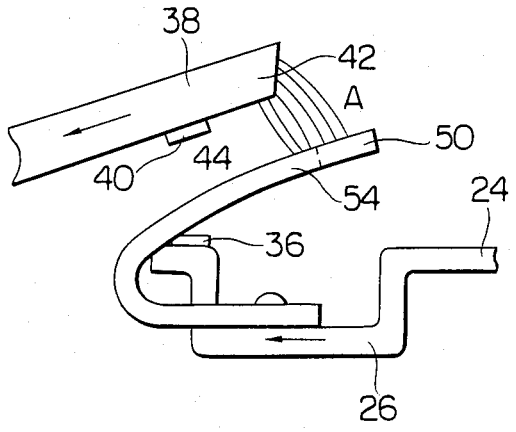
FIG. 9 is a side view of the movable and the stationary contact assemblies with the arc runner of the present invention in the contact open position.
Figure 10:
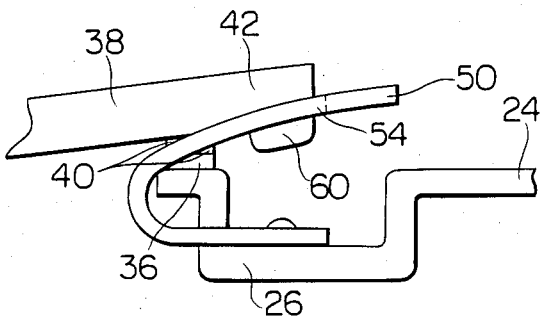
FIG. 10 is a side view of the modified movable and the stationary contact assemblies with the arc runner in the contact closed position.

According to the present invention, the stationary conductor 24 carrying the stationary contact 36 is provided with an arc runner 50 securely mounted on the bight portion 32 of the stationary conductor 24 by a rivet 52 or the like. The arc runner 50 is a generally U-shaped metallic sheet member having formed therein an arc runner slot 54 which opens to substantially surround at its edges the arcing region 14. More specifically, the arc runner 50 is fixed to the stationary conductor 24 at a base 56 which is one of the legs of the "U". The other leg of the "U" or an arc runner portion 58 is connected and supported by a bight portion 60 in a predetermined position in which the arc runner slot 54 is positioned slightly below the level of the top surface of the stationary contact 36 so that the slot 54 substantially surrounds the arcing region 44 as shown in FIGS. 6 to 9. From these figures, it is also seen that when the contacts 36 and 40 are in the closed position shown in FIG. 7, the movable contact 40 is in engagement with the stationary contact 36 and is substantially at the same level as the arc runner 50. When the movable contact 40 starts to separate from the stationary contact 36 as illustrated in FIG. 8, an electric arc A generates between the contacts 36 and 40, and the arc A extends through and is surrounded by the arc runner slot 54. Therefore, the distance between the arc A and the edge of the arc runner slot 54 is sufficiently close so that the legs of the electric arc A are immediately transferred to the arc runner 50 and the arc horn 42 and then driven toward the tip of the arc horn 42 and the tip of the arc runner 50 as illustrated in FIG. 9. Thereafter, the arc A is further transferred to the arc extinguisher 16 (FIG. 5) to be quenched, and the arced gas is exhausted from the insulating casing 2 through the exhaust port 3.

Figure 11:
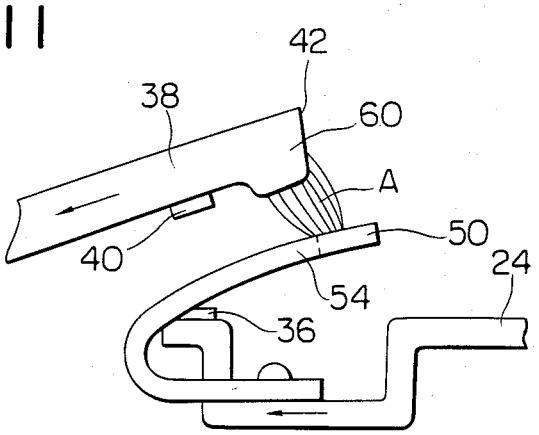
FIG. 11 is a side view of the movable and the stationary contact assemblies shown in FIG. 10 in the contact open position.

The arc horn 42 provided at the tip of the movable contact arm 38 may have a short downward projection 60. This projection 60 is effective for ensuring that the arc A quickly transfers from the position between the separated contacts 36 and 40 to the position between the projection 60 and the arc runner 50 as illustrated in FIG. 11, thereby further decreasing the wear of the movable contact 40.

Figure 12:
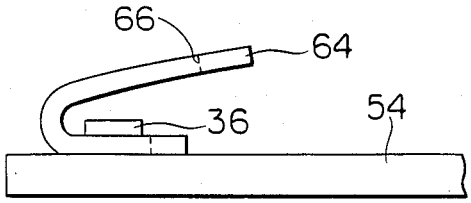
FIG. 12 is a side view of the stationary contact assembly with the arc runner of another embodiment of the present invention.
Figure 13:
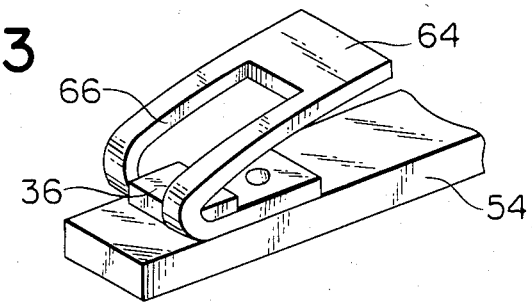
FIG. 13 is a perspective view of the stationary contact assembly shown in FIG. 12.

FIGS. 12 and 13 show another embodiment of the stationary contact assembly of the present invention in which a U-shaped arc runner 64 having an arc runner slot 66 is rigidly attached to an upper surface of a straight stationary conductor 54.

Figure 14:
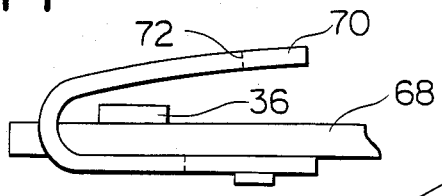
FIG. 14 is a side view of the stationary contact assembly with the arc runner of another embodiment of the present invention.
Figure 15:
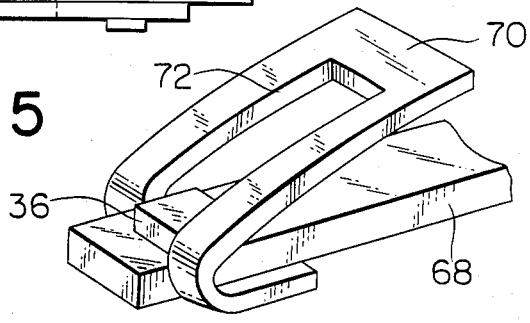
FIG. 15 is a perspective view of the stationary contact assembly shown in FIG. 14.
Figure 16:
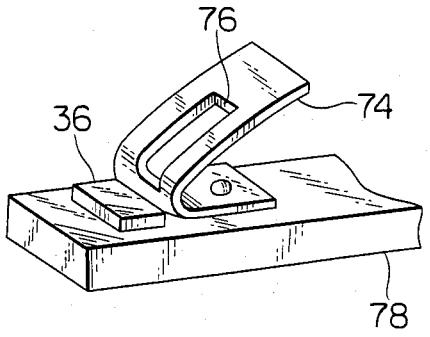
FIG. 16 is a perspective view of the stationary contact assembly with the arc runner of still another embodiment of the present invention.

FIGS. 14 and 15 illustrate a modification of the stationary contact assembly which is different from the embodiment shown in FIGS. 12 and 13 only in the position at which the lower leg of the arc runner 70 having an arc runner slot 72 is attached to the stationary conductor 66.

Figure 17:
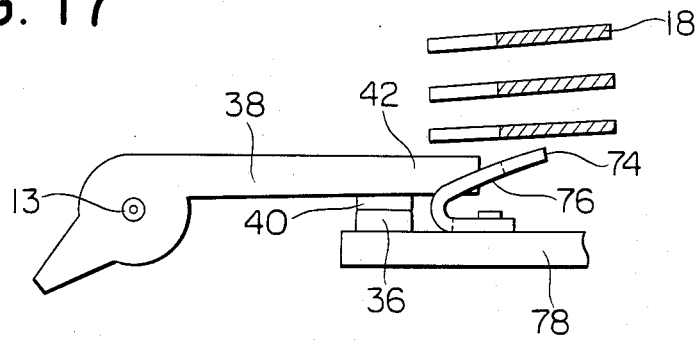
FIG. 17 is a side view of the movable contact assembly and the stationary contact assembly shown in FIG. 16 in the contact closed position.
Figure 18:
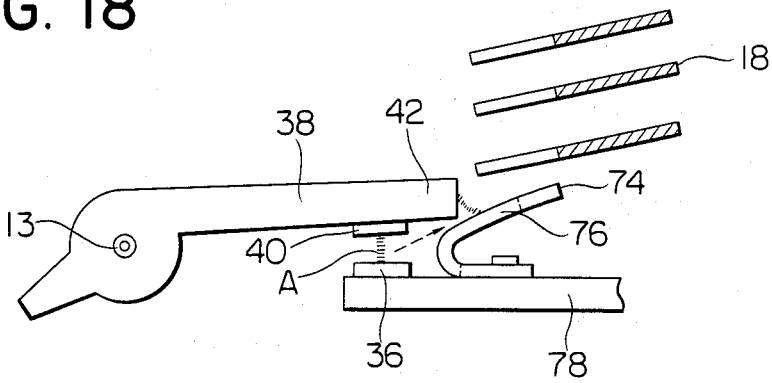
FIG. 18 is a side view of the movable contact assembly and the stationary contact assembly shown in FIG. 17 in the contact opening position.
Figure 19:
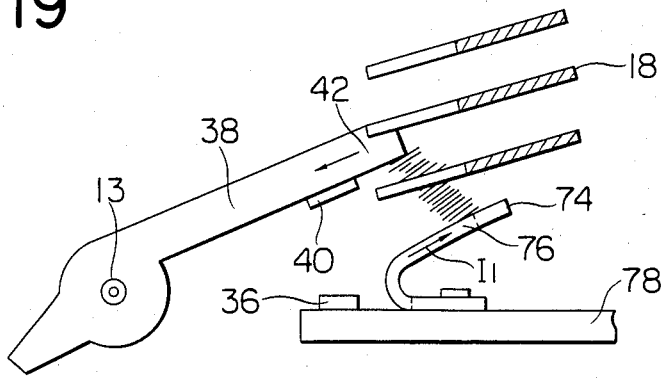
FIG. 19 is a side view of the movable contact assembly and the stationary contact assembly shown in FIG. 17 in the contact open position.
Figure 20:
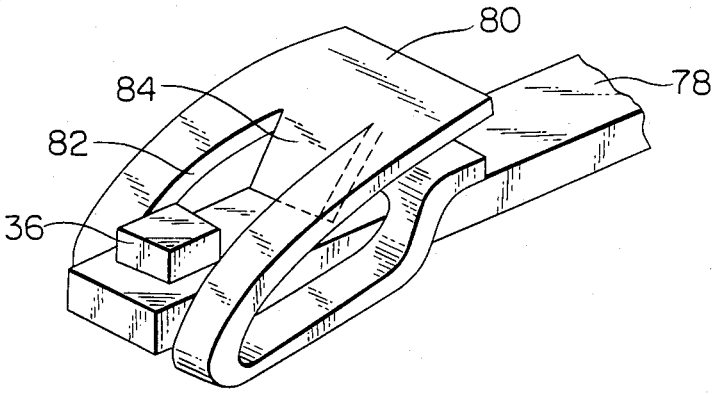
FIG. 20 is a perspective view of the stationary contact assembly with the arc runner of still another embodiment of the present invention.
Figure 21:
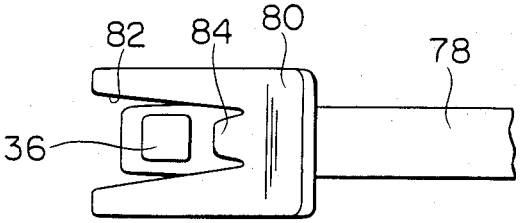
FIG. 21 is a plan view of the assembly shown in FIG. 20.
Figure 22:
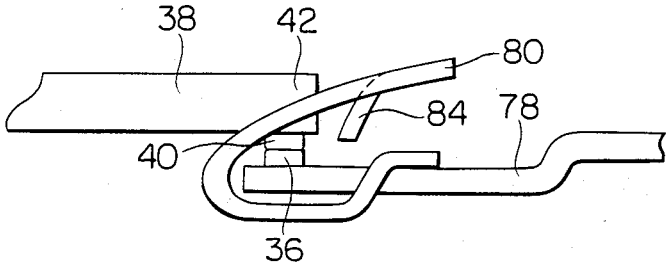
FIG. 22 is a side view of the movable contact assembly and the stationary contact assembly shown in FIG. 21 in the contact closed position.

FIGS. 16 to 19 illustrate still another embodiment in which an arc runner 74 having formed therein an arc runner slot 76 similar to the arc runners 64 and 70 of the embodiments shown in FIGS. 12 to 15 is attached to the upper face of a straight stationary conductor 78. The stationary contact 36 is also attached to the upper surface of the stationary conductor 78. As is apparent from the figures, the stationary contacts 36 of this embodiment is positioned outside of the arc runner slot 76 of the arc runner 74 so that the movable contact 42 of the movable contact arm 38 is completely outside of the arc runner slot 76 even when the movable contact arm 38 is in its contact closed position as shown in FIG. 17. However, the arc horn 42 of the tip of the movable contact arm 38 is partially received within the arc runner slot 76 in the contact closed position as is shown in FIG. 17. Therefore, immediately after the contacts 36 and 40 are separated and an electric arc A generates therebetween as shown in FIG. 18, the arc A quickly transfers from the arcing region 44 between the separated contacts 36 and 40 to the position bridging between the arc horn 42 and the arc runner 74 as shown in FIG. 18. Thereafter, the arc is expanded as the movable contact 38 rotates counterclockwise toward the contact open position illustrated in FIG. 19 and finally the electric arc is extinguished by the arc extinguisher 18.

Figure 23:
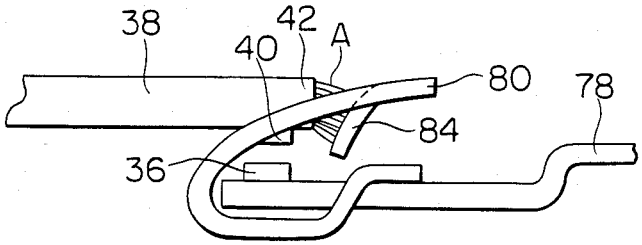
FIG. 23 is a side view of the movable contact assembly and the stationary contact assembly shown in FIG. 21 in the contact opening position.

FIGS. 20 to 23 illustrate another embodiment of the stationary contact assembly of the present invention. In this embodiment, an arc runner 80 has a generally U-shaped configuration similar to the arc runner 50 shown in FIG. 6, but is different in that the arc runner slot 82 of the arc runner 80 has an arc transfer tab 84 which extend downward from the bight portion of the substantially U-shaped arc runner slot 82 and terminates just before it reaches the top surface of the stationary conductor 78. In this embodiment the stationary contact 36 is completely within the arc runner slot 82 and the movable contact 40 and the arc horn 42 of the movable contact arm 38 are also received within the arc runner slot 82 when in the contact closed position shown in FIG. 22. When an electric arc A is generated in the arcing region when the movable contact 40 is separated from the stationary contact 36, hot arced gas which is electrically conductive is generated around the arcing region to fill the region between the arc horn 42 of the movable contact arm 38 and the arc transfer tab 84 of the arc runner 80, and a dielectric breakdown takes place in this region. According to this embodiment, this dielectric breakdown is promoted by providing the arc transfer tab 84 defining a relatively large arc transfer surface. Therefore, as shown in FIG. 23, an electric arc A generated between the stationary and the movable contact 36 and 40 is quickly transferred to the region between the arc transfer tab 84 and the arc horn 42 at the tip of the movable contact arm 38. Therefore, the wear of the contact material of the contacts 36 and 40 is considerably reduced.

Figure 24:
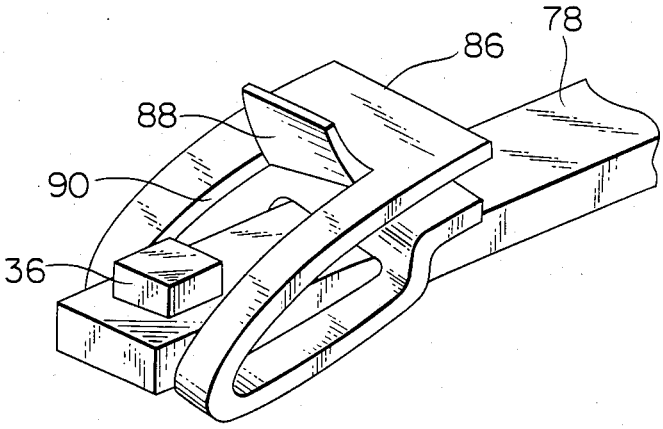
FIG. 24 is a perspective view of the stationary contact assembly with the arc runner of still another embodiment of the present invention.
Figure 25:
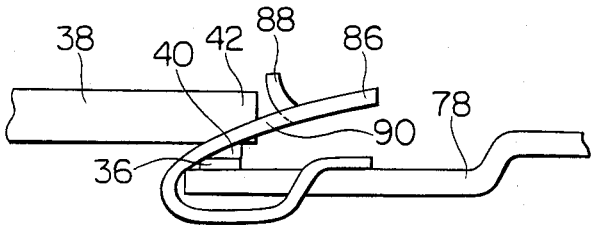
FIG. 25 is a side view of the movable contact assembly and the stationary contact assembly shown in FIG. 24 in the contact closed position.
Figure 26:
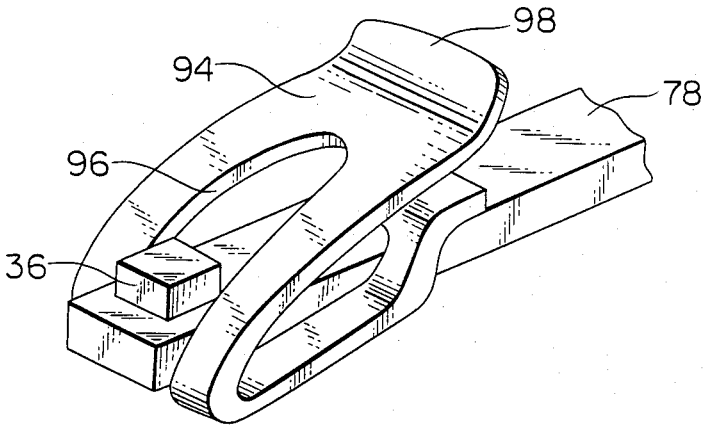
FIG. 26 is a perspective view of the stationary contact assembly with the arc runner of still another embodiment of the present invention.
Figure 27:
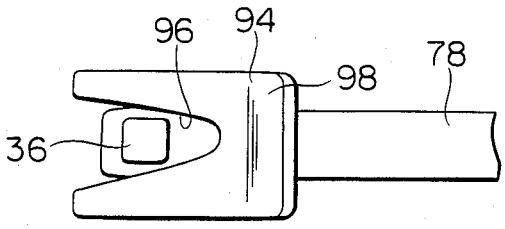
FIG. 27 is a plan view of the assembly shown in FIG. 26.
Figure 28:
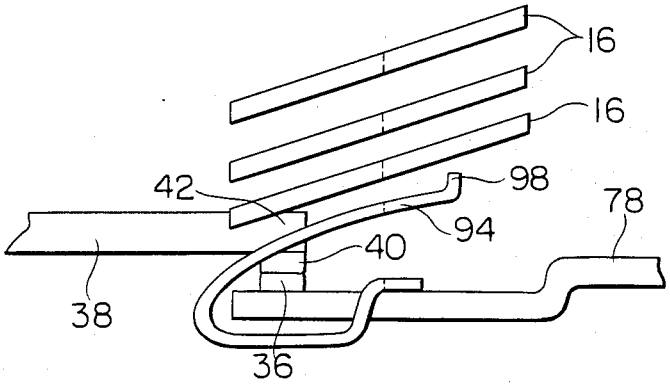
FIG. 28 is a side view of the movable contact assembly and the stationary contact assembly shown in FIG. 26 in the contact closed position.

FIGS. 24 and 25 illustrated a modification of the embodiment shown in FIGS. 20 to 23. In this embodiment, an arc runner 86 is provided with an arc transfer tab 88 extending upward in the vicinity of the arc horn 42 from the bight portion of a substantially U-shaped arc runner slot 90. The arc transfer tab 88 functions in substantially the same manner as the arc transfer tab 84 of the embodiment shown in FIGS. 20 to 23.

Figure 6:
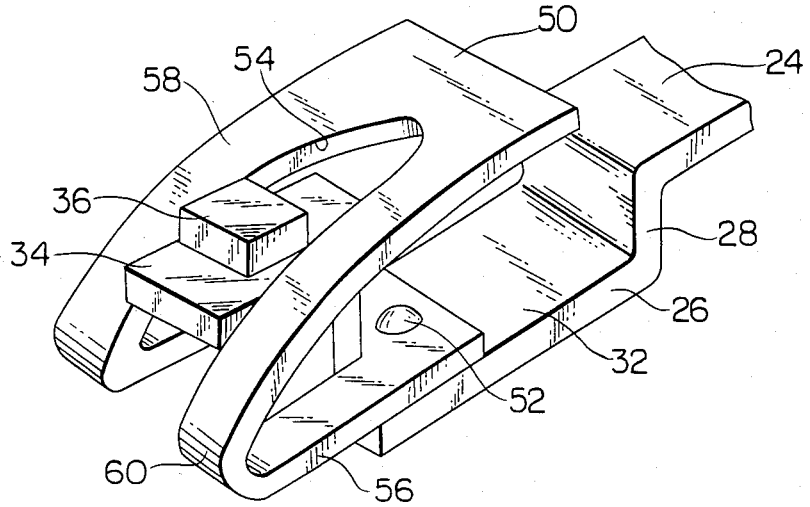
FIG. 6 is a perspective view illustrating the stationary contact assembly with the arc runner of the present invention.
Figure 7:
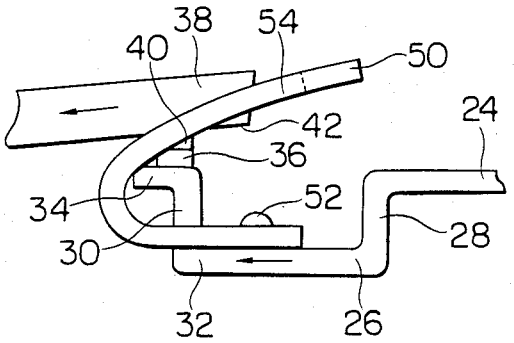
FIG. 7 is a side view of the movable and the stationary contact assemblies with the arc runner of the present invention in the contact closed position.
Figure 29:
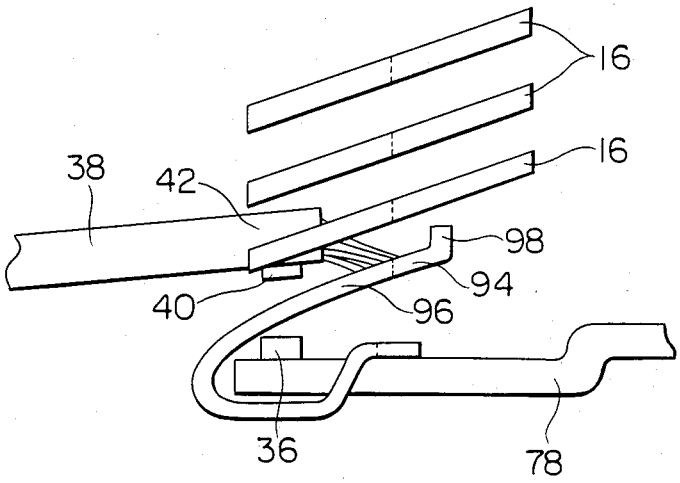
FIG. 29 is a side view of the movable contact assembly and the stationary contact assembly shown in FIG. 26 in the contact opening position.
Figure 30:
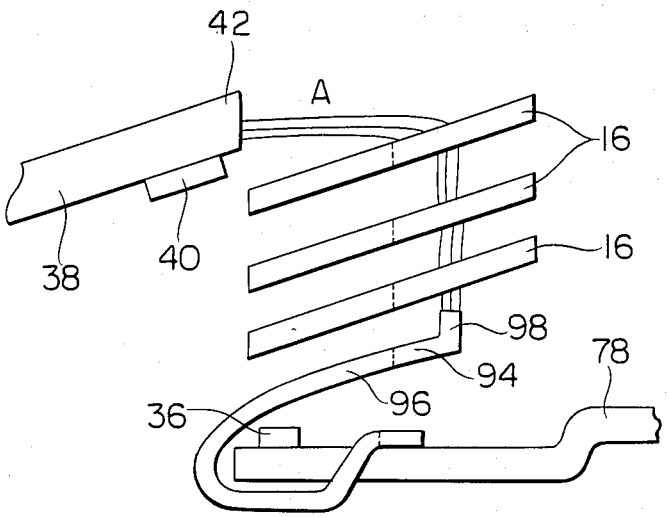
FIG. 30 is a side view of the movable contact assembly and the stationary contact assembly shown in FIG. 26 in the contact open position.

FIGS. 26 to 30 illustrate still another embodiment of the present invention in which the stationary contact arm 78 on which the stationary contact 36 is mounted is provided with an arc runner 94 having formed therein an arc runner slot 96 similar to the slot 54 of FIG. 6. The arc runner 94 is also provided with an arc transfer tab 98 which integrally extends upwardly toward the arc extinguisher plates 16 from the tip of the arc runner 94. As best seen from FIGS. 28 to 30, both the movable contact 40 and the stationary contact 36 are positioned within the arc runner slot 96 in the contact closed position shown in FIG. 28. When the contacts 36 and 40 are separated, an electric arc A generates in the arcing region 44 between the separated contacts 36 and 40 and is quickly transferred to the position between the arc horn 42 of the movable contact arm 38 and the bight portion of the U-shaped arc runner slot 96 of the arc runner 94 as shown in FIG. 29. As the movable contact 38 further rotates, the arc A is driven toward the arc extinguishing plates 16 to extend from the arc transfer tab 98 of the arc runner 94 to the arc horn 42 through the arc extinguishing plates 16 as shown in FIG. 30, thereby to provide a plurality of series arc spots, which is an important element for maintaining a good arc extinguishing capability at the current zero-crossing point, whereby the electric arc A is quickly quenched and extinguished.

Figure 31:
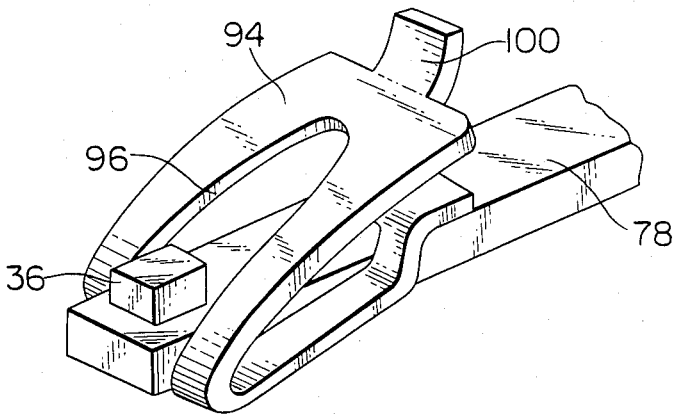
FIG. 31 is a perspective view of the stationary contact assembly with the arc runner of still another embodiment of the present invention.
Figure 32:
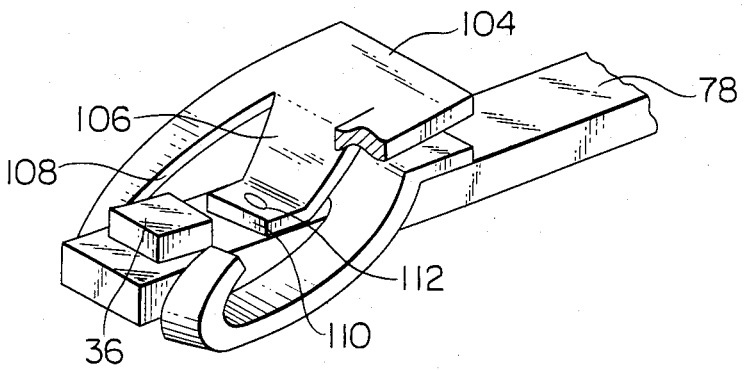
FIG. 32 is a perspective view of the stationary contact assembly with the arc runner of still another embodiment of the present invention.
Figure 33:
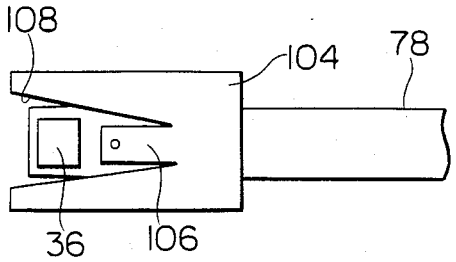
FIG. 33 is a plan view of the assembly shown in FIG. 32.
Figure 34:
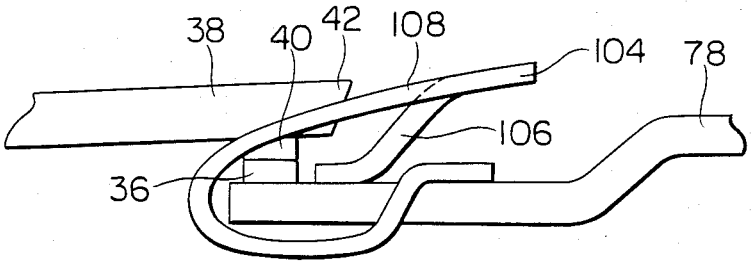
FIG. 34 is a side view of the movable contact assembly and the stationary contact assembly shown in FIG. 32 in the contact open position.

FIG. 31 illustrates a modification of the embodiment shown in FIGS. 27 to 30. It is seen that an arc transfer tab 100 has a narrower width as compared to the arc transfer tab 98 of the previous embodiment. This arrangement functions in the same manner as the embodiment shown in FIGS. 27 to 30.

Figure 35:
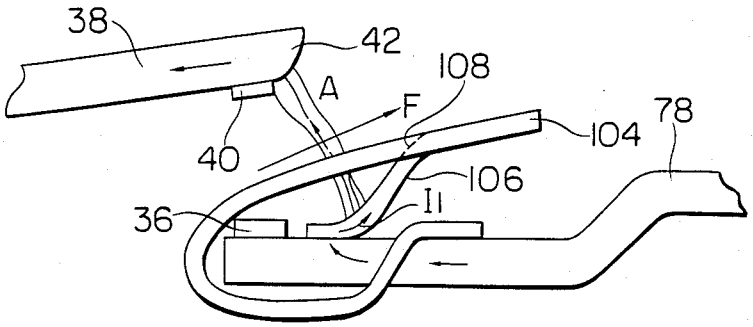
FIG. 35 is a side view of the movable contact assembly and the stationary contact assembly shown in FIG. 32 in the contact opening position.
Figure 36:
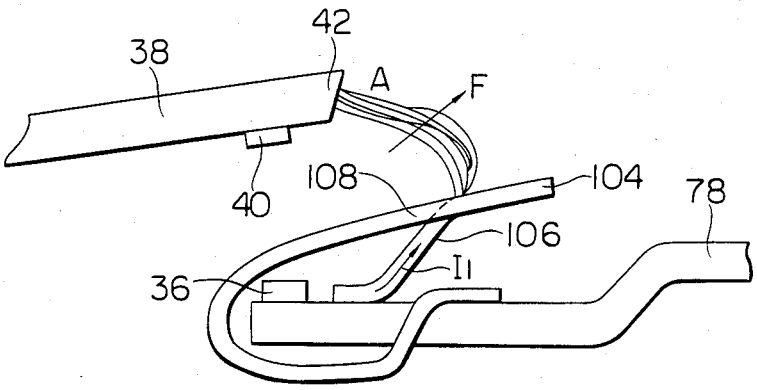
FIG. 36 is a side view of the movable contact assembly and the stationary contact assembly shown in FIG. 32 in the contact open position.

FIGS. 32 to 36 show still another embodiment in which an arc runner 104 is provided with an arc transfer tab 106 which downwardly extends from the bight portion of the substantially U-shaped arc runner slot 108. The arc transfer tab 106 extends to the stationary conductor 78 where its tip end 110 is electrically connected and secured to the top surface of the stationary conductor 78 by a rivet 112 or the like. When the movable contact arm 38 rotates from the contact closed position shown in FIG. 34 to separate the contacts 36 and 40, an electric arc A is established between the separated contacts 36 and 40. This arc A is transferred to the position between the arc horn 42 of the movbale contact arm 38 and the lower end 110 of the arc transfer tab 106 as shown in FIG. 35. At this time, an electric current $I_1$ appears at the lower portion of the arc transfer tab 106 since the lower end 110 of the tab 106 is electrically connected to the stationary conductor 78. This current $I_1$ generates an electromagnetic force F acting on the arc A in the direction shown by an arrow F in FIG. 35, causing the arc A to move toward the position shown in FIG. 36 in which the contact open position is illustrated. The arc A is further driven to the arc extinguishing plates (not shown in FIG. 36) to be quenched and extinguished thereon at the current zero-crossing point.

Figure 37:
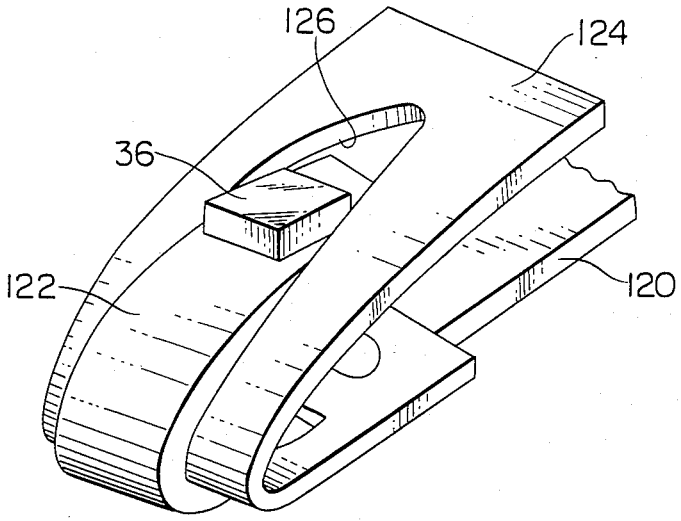
FIG. 37 is a perspective view of the stationary contact assembly with the arc runner of still another embodiment of the present invention.
Figure 38:
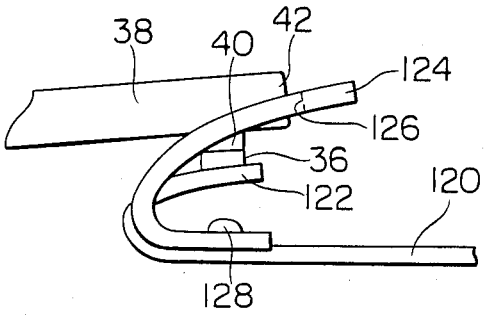
FIG. 38 is a side view of the movable contact assembly and the stationary contact assembly shown in FIG. 37 in the contact closed position.
Figure 39:
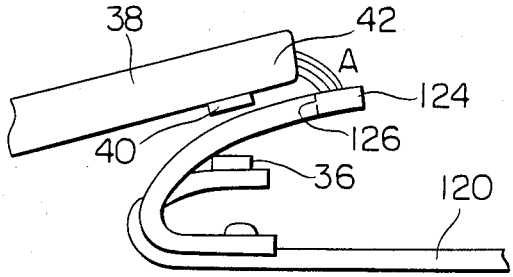
FIG. 39 is a side view of the movable contact assembly and the stationary contact assembly shown in FIG. 37 in the contact opening position.

In FIGS. 37 to 39 in which a still further embodiment of the stationary contact assembly of the present invention is illustrated, it is seen that a stationary conductor 120 is bent into a U-shaped so that a shorter leg 122 extends in a direction parallel and opposite to the movable contact arm 38 when the movable contact arm 38 is in the contact closed position shown in FIG. 38. It is seen that the stationary contact 36 is secured on the shorter leg 122 of the "U". It is also seen that a U-shaped arc runner 124 having formed therein an arc runner slot 126 is secured by any suitable securing means such as a rivet 128 in such a manner that both the movable and the stationary contacts 36 and 40 as well as the arc horn 42 of the movable contact arm 38 is received within the arc runner slot 126 when the movable contact arm 38 is in the closed position shown in FIG. 38. When the movable contact 40 separates from the stationary contact 36, an electric arc A generates between the separated contacts 36 and 40, and is immediately transferred to the position shown in FIG. 39 between the arc horn 42 and the arc runner 124 as shown in FIG. 39 as the movable contact arm 38 rotates toward the contact open position. With this arrangement, since the electric current flowing through the parallel shorter leg 122 of the U-shaped stationary conductor 120 exerts an electromagnetic driving force on the electric arc A generated between the separated contacts 36 and 40, the arc transfer from the position between the contacts 36 and 40 to the position illustrated in FIG. 39 and further to the arc extinguisher such as that shown in FIG. 5.

Figure 40:
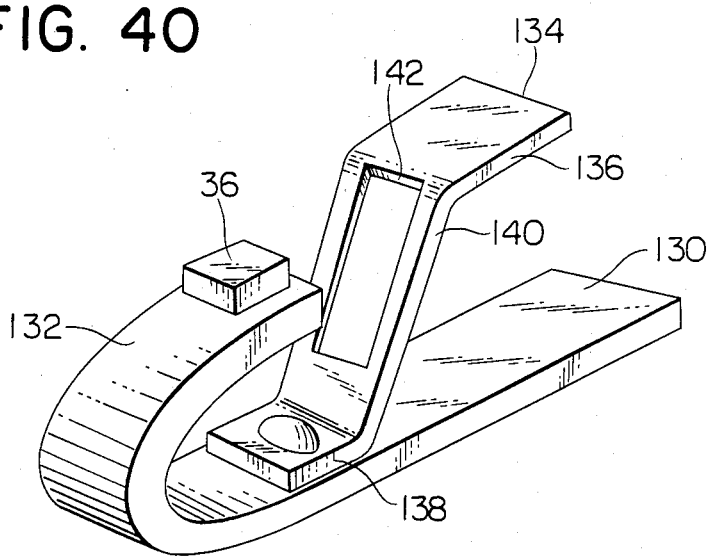
FIG. 40 is a perspective view of the stationary contact assembly with the arc runner of still another embodiment of the present invention.

FIG. 40 shows another modifications of the stationary contact assembly in which a U-shaped stationary conductor 130 carrying the stationary contact 36 on its shorter leg 132 is provided with an arc runner 134. The arc runner 134 has a general configuration of "Z" or an escalator in the sense that the arc runner 134 comprises an upper horizontal section 136 and an lower horizontal section 138 and an intermediate slope section 140. An arc runner slot 142 is provided in the intermediate slope section 140 so that at least one of the arc horn (such as the arc horn 42 shown in FIG. 39) and the movable contact (such as the movable contact 36 shown in FIG. 39) is accommodated within the arc runner slot 142 when the contacts are closed. This arrangement functions in a similar manner to the one illustrated and described in conjunction with FIGS. 37 to 39.

Figure 41:
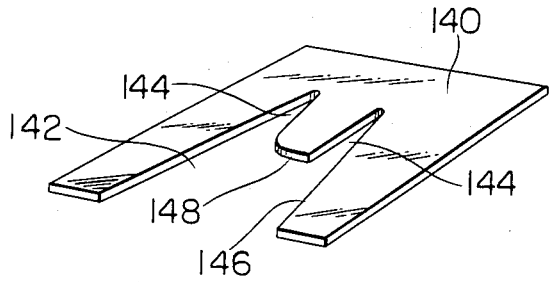
FIGS. 41 to 46 illustrate various arc extinguishing plates which can be employed in the circuit interrupter of the present invention.
Figure 42:
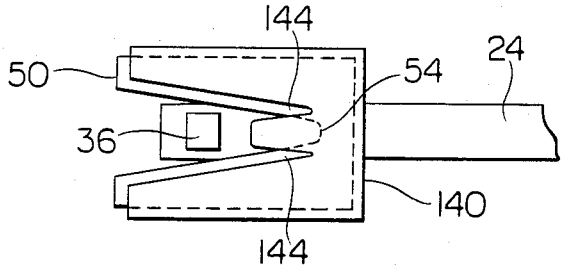

In FIGS. 41 to 46, various modifications of the arc extinguishing plates constituting the arc extinguisher which can be used together with the various stationary conductor assemblies embodying the present invention are illustrated. In FIGS. 41 and 42, an arc extinguishing plate 140 made of a sheet of a magnetic material has formed therein a substantially U-shaped arc extinguisher slot 142. The arc extinguisher slot 142 includes a pair of narrower sharp notches 144 at the corners or the portions between two legs 146 and the bight portion 148 of the "U" of the arc extinguisher slot 142. One or more arc extinguishing plates 140 is placed over the arc runner, such as the arc runner 50 shown and described in conjunction with FIGS. 5 to 11, in registry with the arc runner as shown in FIG. 42. As is well known in the art, two or more arc extinguishing plates 140 may be stacked with a predetermined distance therebetween to constitute an arc extinguisher such as the arc extinguisher 16 described in conjunction with FIG. 5. With this arrangement, the electric arc is drawn into the narrower notches 144 and is sufficiently elongated.

Figure 43:
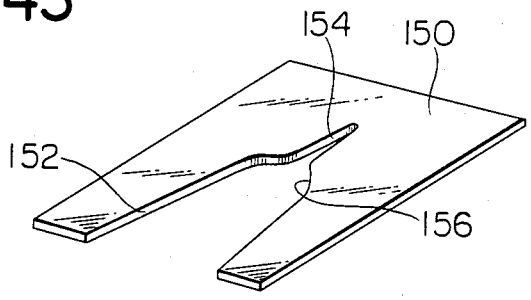

In FIG. 43, an arc extinguishing plate 150 has a substantially U-shaped arc extinguisher slot 152 having a single, central narrower sharp notch 154 open at the bight portion 156 of the "U" of the slot 152. This sharp notch 154 functions in a manner similar to those shown in FIGS. 41 and 42.

Figure 44:
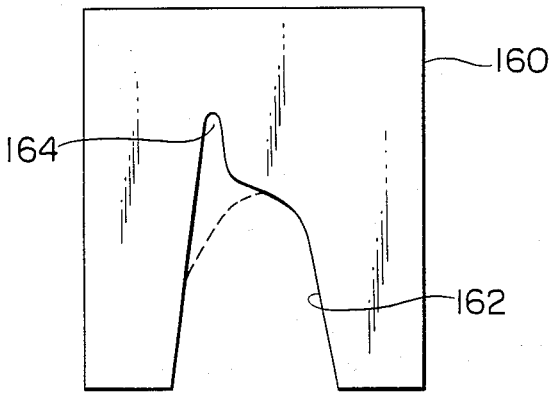
Figure 45:
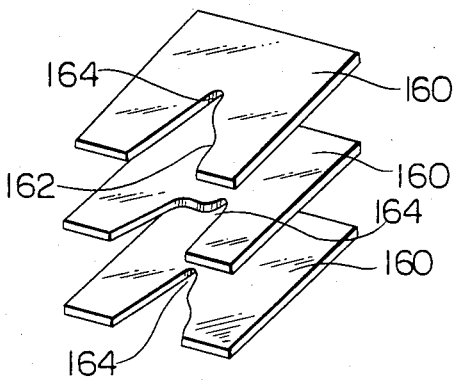
Figure 46:
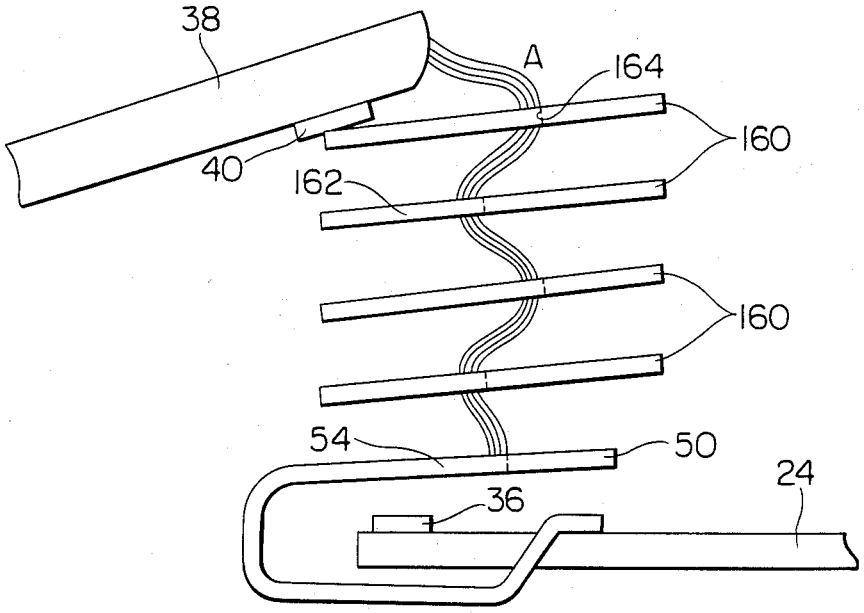

In FIG. 44, an arc extinguishing plate 160 has formed therein a substantially U-shaped arc extinguisher notch 162 with a single sharp notch 164. It is to be noted that the narrower notch 164 is positioned at the alternative one of the corners of the "U" of the arc extinguisher slot 162. In other words, the position of the narrower notch 164 is such that, when the arc extinguishing plates 160 are stacked to form an arc extinguisher, such as the arc extinguisher 18, the electric arc A drawn into the narrow notch 164 is shaped into a zig-zag as illustrated in FIG. 46. With this arrangement, the electric arc A is sufficiently elongated and quenched by the arc extinguisher 18, and even a small current can be efficiently interrupted.

While the present invention has been described in terms of particular embodiments of a limited number, other combinations of various components may equally be employed when desired.

What is claimed is:

1. A circuit interrupter comprising in a housing:

a stationary contact;

a stationary conductor carrying said stationary contact;

a movable contact;

a movable contact arm carring said movable contact;

an operating mechanism for moving said movable contact arm between contact-closed and contact-open positions in response to an overcurrent flowing through said circuit interrupter, said stationary and movable contacts defining therein an arcing region in which an electric arc is established when said contacts are tripped open;

an arc extinguisher including a plurality of arc extinguisher plates disposed in a facing relationship with said arcing region for cooling and extinguishing the electric arc;

an arc horn on said movable contact arm and providing a surface to which one of the legs of the electric arc is transferred from said contact when said movable contact is moved toward the open position after being tripped open;

an arc runner mounted on said stationary conductor and providing a surface to which the other of the legs of the electric arc is transferred from said stationary contact when said movable contact is moved toward the open position after being tripped open;

said arc runner having formed therein an arc runner slot which opens to substantially surround said arcing region;

said arc runner and said stationary contact being positioned such that at least one of said movable contact and said arc horn of said movable contact arm is located within said arc runner slot of said arc runner when said contacts are in a closed position.

2. A circuit interrupter comprising in a housing:

a stationary contact;

a stationary conductor carrying said stationary contact;

a movable contact;

a movable contact arm carring said movable contact;

an operating mechanism for moving said movable contact arm between contact-closed and contact-open positions in response to an overcurrent flowing through said circuit interrupter, said stationary and movable contacts defining therein an arcing region in which an electric arc is established when said contacts are tripped open;

an arc extinguisher including a plurality of arc extinguisher plates disposed in a facing relationship with said arcing region for cooling and extinguishing the electric arc;

an arc horn on said movable contact arm and providing a surface to which one of the legs of the electric arc is transferred from said contact when said movable contact is moved toward the open position after being tripped open;

an arc runner mounted on said stationary conductor and providing a surface to which the other of the legs of the electric arc is transferred from said stationary contact when said movable contact is moved toward the open position after being tripped open;

said arc runner having formed therein an arc runner slot which opens to substantially surround said arcing region;

said arc runner and said stationary contact being positioned such that said movable contact and said arc horn are both located within said arc runner slot when said contacts are in the closed position.

3. A circuit interrupter comprising in a housing:

a stationary contact;

a stationary conductor carring said stationary contact;

a movable contact;

a movable contact arm carrying said movable contact;

an operating mechanism for moving said movable contact arm between contact-closed and contact-open positions in response to an overcurrent flowing through said circuit interrupter, said stationary and movable contacts defining therein an arcing region in which an electric arc is established when said contacts are tripped open;

an arc extinguisher including a plurality of arc extinguisher plates disposed in a facing relationship with said arcing region for cooling and extinguishing the electric arc;

an arc horn on said movable contact arm and providing a surface to which one of the legs of the electric arc is transferred from said contact when said movable contact is moved toward the open position after being tripped open;

an arc runner mounted on said stationary conductor and providing a surface to which the other of the legs of the electric arc is transferred from said stationary contact when said movable contact is moved toward the open position after being tripped open;

said arc runner having formed therein an arc runner slot which opens to substantially surround said arcing region;

said arc horn alone is located within said arc runner slot when said contacts are in the closed position.

4. A circuit interrupter comprising in a housing;

a stationary contact;

a stationary conductor carrying said stationary contact;

a movable contact;

a movable contact arm carring said movable contact;

an operating mechanism for moving said movable contact arm between contact-closed and contact-open positions in response to an overcurrent flowing through said circuit interrupter, said stationary and movable contacts defining therein an arcing region in which an electric arc is established when said contacts are tripped open;

an arc extinguisher including a plurality of arc extinguisher plates disposed in a facing relationship with said arcing region for cooling and extinguishing the electric arc;

an arc horn on said movable contact arm and providing a surface to which one of the legs of the electric arc is transferred from said contact when said movable contact is moved toward the open position after being tripped open;

an arc runner mounted on said stationary conductor and providing a surface to which the other of the legs of the electric arc is transferred from said stationary contact when said movable contact is moved toward the open position after being tripped open;

said arc runner having formed therein an arc runner slot which opens to substantially surround said arcing region;

said arc runner comprising a metallic sheet bent into a "U", said arc runner slot being a cut-out portion at the bight portion of the "U" with one of the legs of the "U" rigidly attached to said stationary conductor;

said arc runner and said stationary contact being positioned such that at least one of said movable contact and said arc horn of said movable contact arm is located within said arc runner slot of said arc runner when said contacts are in a closed position;

5. A circuit interrupter as claimed in claim 4 wherein said arc runner comprises an arc transfer tab on which the electric arc can be transferred.

6. A circuit interrupter as claimed in claim 5 wherein said arc transfer tab extends from one end of said arc runner slot toward said stationary conductor adjacent to said stationary contact.

7. A circuit interrupter as claimed in claim 6 wherein the tip of said arc transfer tab is connected to said stationary conductor.

8. A circuit interrupter as claimed in claim 6 wherein the tip of said arc transfer tab is terminated before it reaches said stationary conductor.

9. A circuit interrupter as claimed in claim 5 wherein said arc transfer tab extends from one end of said arc runner slot away from said stationary conductor.

10. A circuit interrupter as claimed in claim 5 wherein said arc transfer tab extends from the tip of said arc runner toward said arc extinguisher.

11. A circuit interrupter as claimed in claim 9 wherein said arc transfer tab has a width substantially equal to the width of said tip of said arc runner.

12. A circuit interrupter as claimed in claim 9 wherein said arc transfer tab has a width narrower than that of the tip of said arc runner.

13. A circuit interrupter as claimed in claim 1 wherein said stationary conductor comprises a U-shaped rigid conductor having said stationary contact disposed on one of the legs of the "U", said leg having said stationary contact thereon extends in a direction parallel and opposite to said movable contact arm when said movable contact arm is in the closed position.

14. A circuit interrupter as claimed in claim 13 wherein said arc runner comprises a metallic sheet bent substantially into a "U", said arc runner slot being a cut-out portion at the bight portion of the "U" with one of the legs of the "U" rigidly attached to said stationary conductor.

15. A circuit interrupter as claimed in claim 13 wherein said arc runner comprises a metallic sheet bent substantially into a "Z", said arc runner slot being a cut-out portion at the intermediate slanted leg of the "Z" with one of the horizontal legs of the "Z" rigidly attached to said stationary conductor.

16. A circuit interrupter as claimed in claim 1 wherein each of said arc extinguishing plates has formed therein a substantially U-shaped arc extinguisher slot opening toward said arcing region.

17. A circuit interrupter as claimed in claim 16 wherein said arc extinguisher plates having a narrower notch open at the bight portion of the "U" of said arc extinguisher slot.

18. A circuit interrupter as claimed in claim 16 wherein, said arc extinguisher plates having a narrower notch open at each corner of the bight portion of the "U" of said arc extinguisher slot.

19. A circuit interrupter as claimed in claim 16 wherein, said arc extinguisher plates having a narrower notch open at alternative one of the corners of the bight portion of the "U" of said arc extinguisher slot.

20. A circuit interrupter as claimed in claim 1 wherein said arc horn comprises an extension of said movable contact arm extending beyond said movable contact.

21. A circuit interrupter as claimed in claim 20 wherein said extension of said movable contact arm has formed thereon a projection projecting toward said stationary conductor.

* * * * *